US006338497B1

(12) United States Patent
Chevalier et al.

(10) Patent No.: US 6,338,497 B1
(45) Date of Patent: Jan. 15, 2002

(54) RELEASABLE BINDING FOR GLIDING BOARD

(75) Inventors: Jean-Louis Chevalier, Varennes Vauzelles; Jean-Marc Hillairet; Christophe Juge, both of Nevers, all of (FR)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/488,147

(22) Filed: Jan. 19, 2000

(30) Foreign Application Priority Data

Jan. 20, 1999 (FR) ..... 99 00727
Mar. 31, 1999 (FR) ..... 99 04218

(51) Int. Cl.[7] ..... A63C 9/08
(52) U.S. Cl. ..... 280/612; 280/617; 280/636
(58) Field of Search ..... 280/611, 612, 280/613, 614, 615, 617, 618, 624, 633, 635, 636, 630

(56) References Cited

U.S. PATENT DOCUMENTS

| | | | | | |
|---|---|---|---|---|---|
| 3,560,011 | A | | 2/1971 | Spademan | |
| 3,647,235 | A | | 3/1972 | Beyl | |
| 4,027,896 | A | * | 6/1977 | Frechin et al. | 280/618 |
| 4,143,886 | A | | 3/1979 | Salomon | |
| 4,314,714 | A | * | 2/1982 | Gertsch | 280/630 |
| 4,394,032 | A | * | 7/1983 | Storandt et al. | 280/618 |
| 4,415,176 | A | * | 11/1983 | Hull et al. | 280/612 |
| 4,418,937 | A | * | 12/1983 | Salomon | 280/613 |
| 4,465,295 | A | * | 8/1984 | Spademan | 280/612 |
| 5,066,036 | A | * | 11/1991 | Broughton | 280/615 |
| 5,085,453 | A | * | 2/1992 | Bilder | 280/612 |
| 5,799,966 | A | | 9/1998 | Haldemann | |

FOREIGN PATENT DOCUMENTS

| | | |
|---|---|---|
| DE | 1194300 A | 6/1965 |
| DE | 19 51 155 A | 6/1970 |
| DE | 19 60 002 A | 6/1970 |
| FR | 2409064 | 11/1978 |
| FR | 2 553 671 A | 4/1985 |
| WO | WO 79/00311 | 6/1979 |

OTHER PUBLICATIONS

Preliminary Search Report in SN 99 00727—France.
Preliminary Search Report in SN 9904218—France.

* cited by examiner

*Primary Examiner*—Lanna Mai
*Assistant Examiner*—Hau Phan
(74) *Attorney, Agent, or Firm*—Bugnion S.A.; John Moetteli

(57) ABSTRACT

A binding, comprises a pair of jaws (7,8) which can be moved apart from one another laterally while pushing back a cam (13) acted on by springs (19) and additional holding means, such as a jaw (21) located in front of or behind the lateral jaws and capable of tilting, preferably about a swivel, s against the action of the springs. The binding is intended to receive a part (2) integrated with the sole of the boot. The binding further comprises a lever for intentional boot release (24).

14 Claims, 4 Drawing Sheets

RELEASABLE BINDING FOR GLIDING BOARD

BACKGROUND OF THE INVENTION

The present invention relates to a releasable binding for a gliding board, comprising a part secured to a boot and a part intended to be fixed on a gliding board, in which the part intended to be fixed to the gliding board comprises a pair of jaws which can be moved apart from one another and an elastic means opposing this movement apart, and in which the jaws and the part secured to the boot are designed so as to make it possible for the jaws to be moved apart, by the part secured to the boot when the boot is being fitted in the binding and upon release and to hold the boot on the gliding board after the boot has been fitted.

Such a binding is known from Patent FR 2 409 064. In this binding, the sole of the boot is fitted with a plate retained between the two jaws of the binding, the lateral sides of this plate having a hollow cutout in order to provide longitudinal holding of the boot. Each of these jaws is mounted at the end of an arm capable of pivoting about a vertical axis.

Bindings of the same type are described in Patents U.S. Pat. No. 4,143,886 and U.S. Pat. No. 5,799,966, the contents of which are incorporated by reference. These bindings also include a pair of jaws and are characterized by the presence of rods for transmitting the forces from the spring to the jaws articulated about a vertical axis.

Still further, U.S. Pat. No. 3,647,235, the content of which is incorporated herein by reference, and French Patent 2553671 describe such an invention. However, in both cases, it is necessary that both bindings swivel in order to insert a boot Some of the prior art bindings have the advantage, on the one hand, of responding well to a twisting movement of the leg because of their position in the central part of the boot and, on the other, of being capable of being used for boots of different lengths without the need for adjustment. In such bindings, it is certainly easy to ensure good lateral gripping of the sole of the boot or of the metal plate fixed to this sole, by the jaws. However, the same is not true as regards the holding of the boot along a determined axis of the gliding board. This is because, even though the shape of the jaws is perfectly matched to the shape of the plate of the boot the spring which holds the jaws would need to be excessively powerful in order to prevent any rotational movement about a vertical axis. Further, wear on the jaws and the plate of the boot increases the possibility of rotation, which, even if very limited, equates to play for the user, which play makes control of the gliding board inaccurate and creates a feeling of insecurity. A similar play also appears when the skier presses on the rear of the boot.

Keeping the idea of retaining the boot by a pair of jaws which are located in the central region of the sole of the boot, what is needed is an in invention which avoids the drawbacks of the bindings according to the prior art, that is to say to produce a binding with lateral jaws which provide improved holding of the boot in its longitudinal direction.

SUMMARY OF THE INVENTION

A binding is provided wherein the boot is reed by a pair of jaws which are located in the central region of the sole of the boot, in which the binding has lateral jaws providing improved holding of the boot in its longitudinal direction.

The binding further comprises additional holding means, retained elastically, opposing at least a twisting movement about an at least approximately vertical axis of the part secured to the boot these additional means being preferably located in front of the jaws, relative to the heel of the boot.

Hence, even in the presence of angular play of the boot in the jaws, the additional holding of this boot neutralizes this angular play.

As explained above, the angular play is produced both dug slight twisting movements and because of wear.

The additional holding means could also retain the boot against wrenching, that is to say like conventional toe pieces.

The additional holding means preferably consist of a jaw articulated by a swivel joint and of a slide held bearing against the lower part of said jaw by said elastic means, so as to hold the jaw elastically in a determined position.

The swivel joint allows the jaw to pivot in all directions in the space above the binding. The boot can hence come out of the jaw both in the event of twisting and in the event of falling forward or backwards.

According to a preferred embodiment of the invention, the elastic means retaining the jaw pair is mounted between the pair of jaws and the jaw of the additional holding means, so as simultaneously to provide retention of the jaw of the additional holding means.

A binding of this type is therefore no builder than the bindings according to the prior art. The elastic means is covered by the sole of the boot and extends over a length substantially shorter than the length of the boot.

The jaws of the pair of jaws are in the form of a lever of the first class whose axis is parallel to the longitudinal axis of the binding, and they bear on a horizontally and axially sliding V-shaped cam retained by the elastic means.

The common elastic means, mounted between the V-shaped cam and the slide on which the jaw of the additional holding means bears, consists, for example, of one or two springs working in compression or of at least one leaf working in buckling mode.

BRIEF DESCRIPTION OF THE DRAWINGS

The appended drawing represents, by way of example, one embodiment of the invention as well as a slightly modified embodiment.

DETAILED DESCRIPTION OF THE PREFERRED EMBODIMENTS

The binding represented consists essentially of a part 1 (FIG. 1) intended to be fitted to a gliding board, for example a ski, and of a part 2 (FIGS. 3 and 4) integrated with a boot sole and intended to connect to the part 1.

Figure 2:
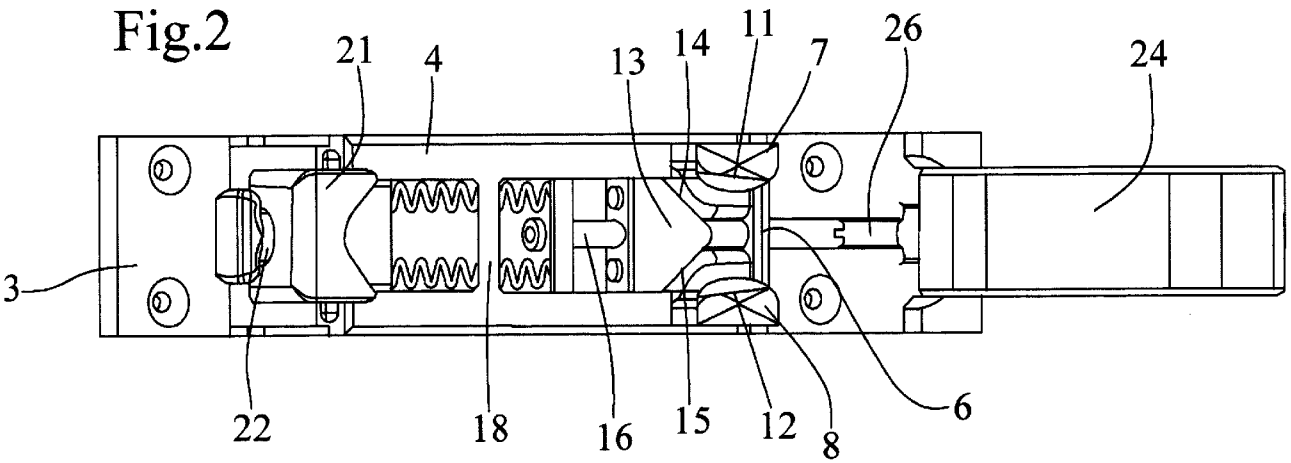
FIG. 2 is a second perspective view of the same part.
Figure 8:
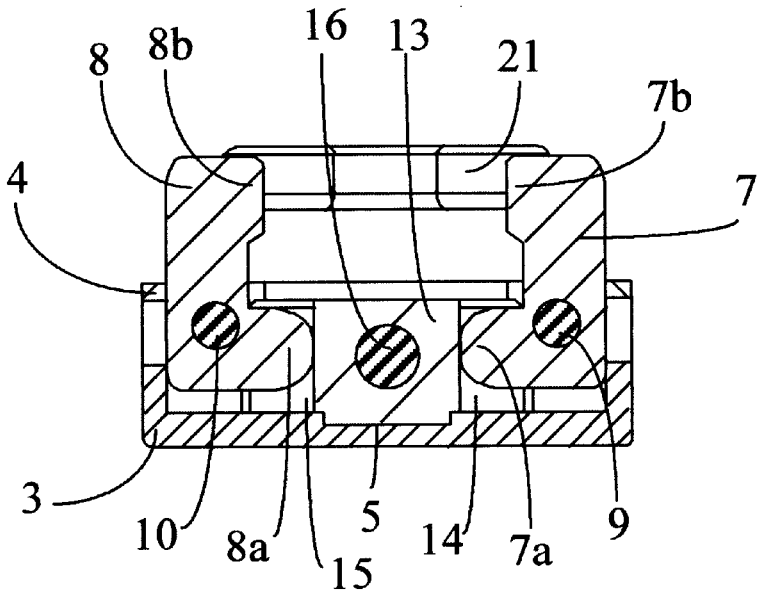
FIG. 8 is a view ill section on VIII—VIII of FIG. 7 without the boot sole.
Figure 6:
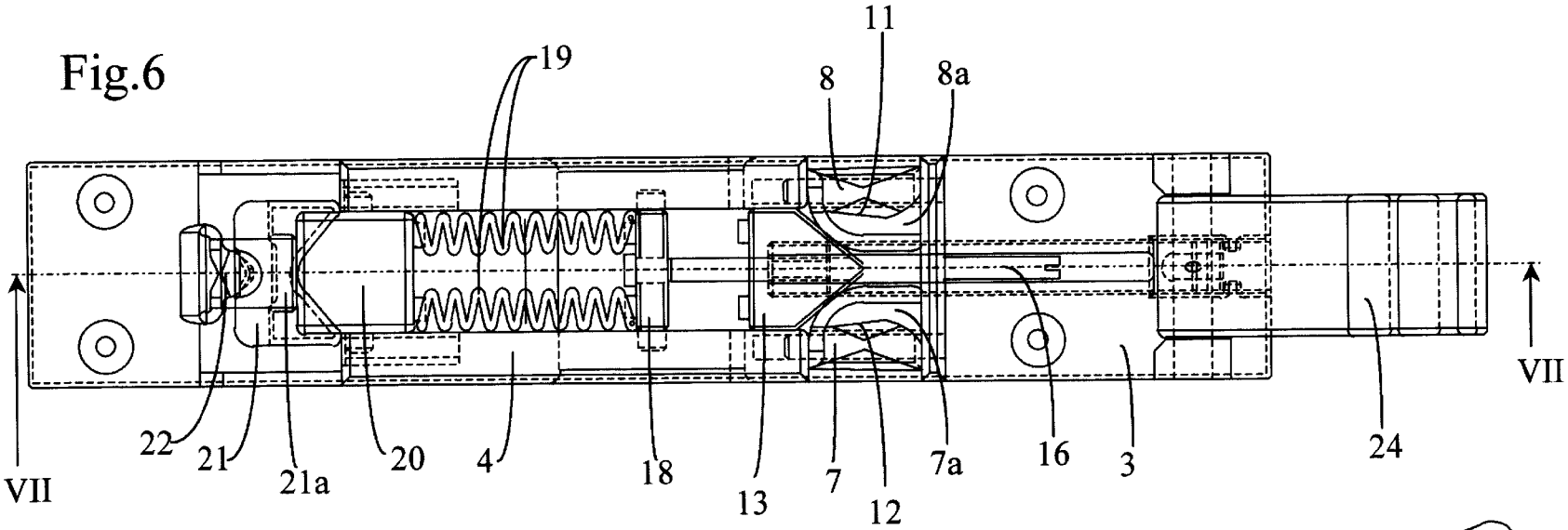
FIG. 6 is a top view of the part represented in FIGS. 1 and 2.

The part 1 comprises a base 3 having four holes for fastening it to the ski and whose central part is formed as a rail 4. Over a part of its length, the base 3 has a longitudinal central groove 5. Across the groove 5, the base further has a transverse rib 6 which, with the neighboring end of the rail 4, defines two recesses in which two lateral jaws 7 and 8, respectively articulated about a pin 9, 10 extending parallel to the longitudinal axis of the base, are mounted. At their upper end, on their inner side, these jaws 7 and have a chamfer 11, 12, respectively, of an engagement ramp for fitting the boot. The ramps 11 and 12 are also oriented obliquely relative to the longitudinal axis of the binding so as to converge in the direction of the rear of the binding. As can be seen in FIG. 8, the jaws 7 and 8 are in the form of a lever of the first class articulated about pins 9 and 10. The lower arms 7*a*, 8*a*, respectively, of these levers have, in plan view, a rounded side via which they bear on a cam 13, or more precisely on the two sides 14 and of a V-shape constituting the cam proper (FIGS. 2 and 6). The cam 13 is mounted so as to slide in the rail 4. The upper arms of the jaws 7 and 8 have a projection 7*b*, 8*b*, respectively, intended to be attached onto the part 2 secured to the boot.

The cam 13 has a threaded axial hole with a longitudinal screw 16 that is engaged partially in the groove 5 and whose opposite end from the screw slot 17 is journalled in a support piece 18 guided in the rail 4. This support piece 18 bears on a pair of parallel springs 19 working in compression between the support piece 18 and the slide 20. The thrust exerted by the springs 19 on the cam 13 has the effect of holding the jaws 7 and 8 in the position represented. As can be seen in FIG. 8, the jaws butt against the sides of the base 3, so a they are held in a vertical position.

Figure 1:
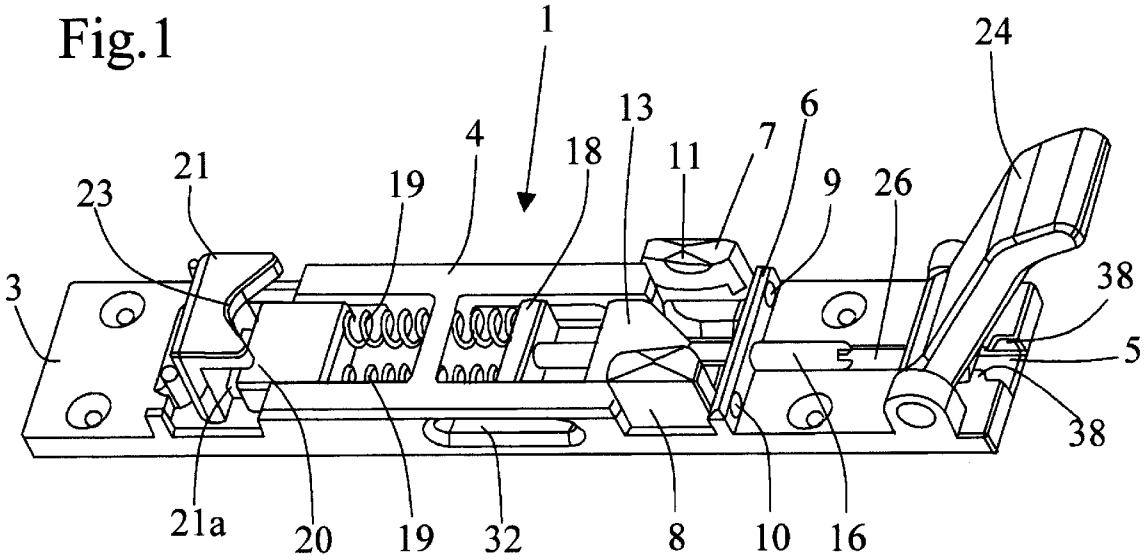
FIG. 1 is a first perspective view of the part of the binding intended to be fixed to the gliding board.
Figure 7:
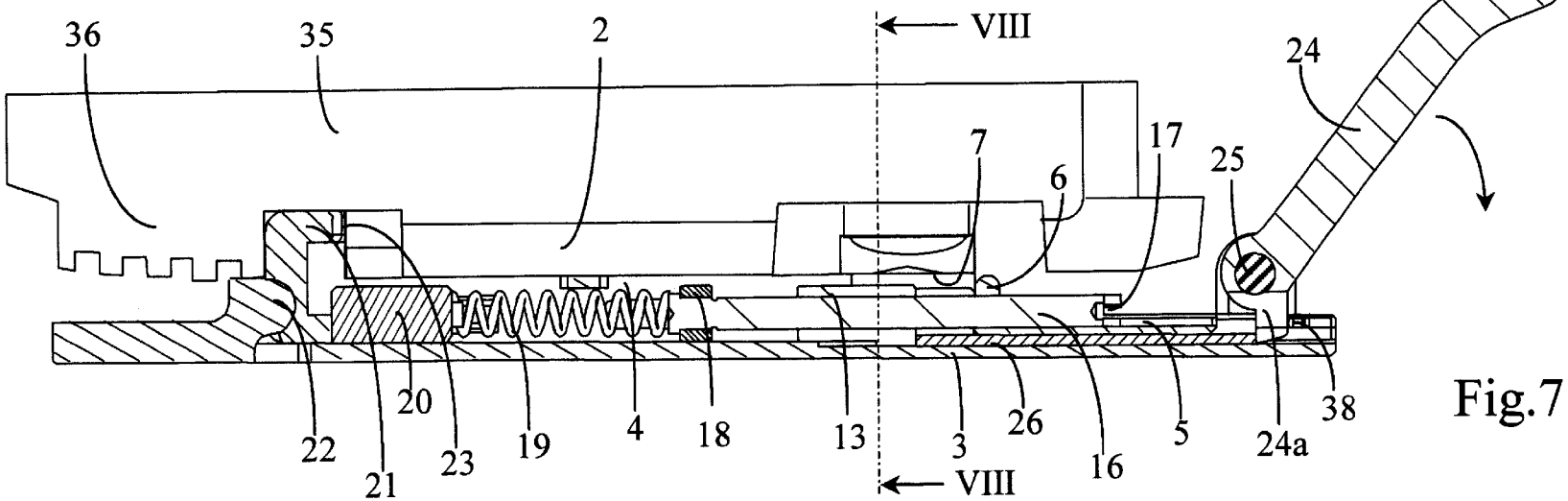
FIG. 7 is a view in longitudinal axial section on VII—VII of FIG. 5. of the binding fitted with the boot sole, not sectioned.

A front jaw 21, against which the slide 20 comes to bear, is mounted facing the other end of the rail 4. As can be seen in FIGS. 6 and 7, the jaw is retained on the base 3 by a swivel joint 22, so that the jaw 21 can pivot in all directions in the space above the base 3 in vertical axial section, as represented in FIG. 7, the front jaw 21 has a C-shape whose lower part 21*a* bears against the slide 20 which, when at rest, holds the jaw 21 in a vertical position. The upper part of the jaw 21 extends parallel to the base 3 and has an open V-shaped notch 23. As can be seen in FIGS. 1 and 6, the lower part 21*a* of the jaw 21 extends over only a part of the width of the jaw and over only a part of the width of the slide 20, which has a plane front face perpendicular to the longitudinal a of the base, against which the part 21*a* bears. The springs 19 work in compression between the support piece 18 and the slide 20, and it is hence the same springs tat retain the lateral jaws 7 and 8 and the front jaw 21. The precompression of the springs 19, that is to say the hardness upon release of the binding, is adjusted by means of the screw 16, which makes it possible to move the support piece 18 by bearing an the cam 13.

Further, a lever 24 is articulated on the base 3 about a transverse pin 25. The lower arm 24*a* of the lever 24 bears against a bar 26 mounted so as to slide in the groove 5 and itself bearing against the cam 13. The lever 24, pushed back by the bar 26, is retained by a pair of stops 38, The effect of pressure on the lever 24 is to push back the cam 13 by means of the bar 26, and consequently to allow the jaws 7 and 8 to tilt outward while moving away from one another.

Figure 4:
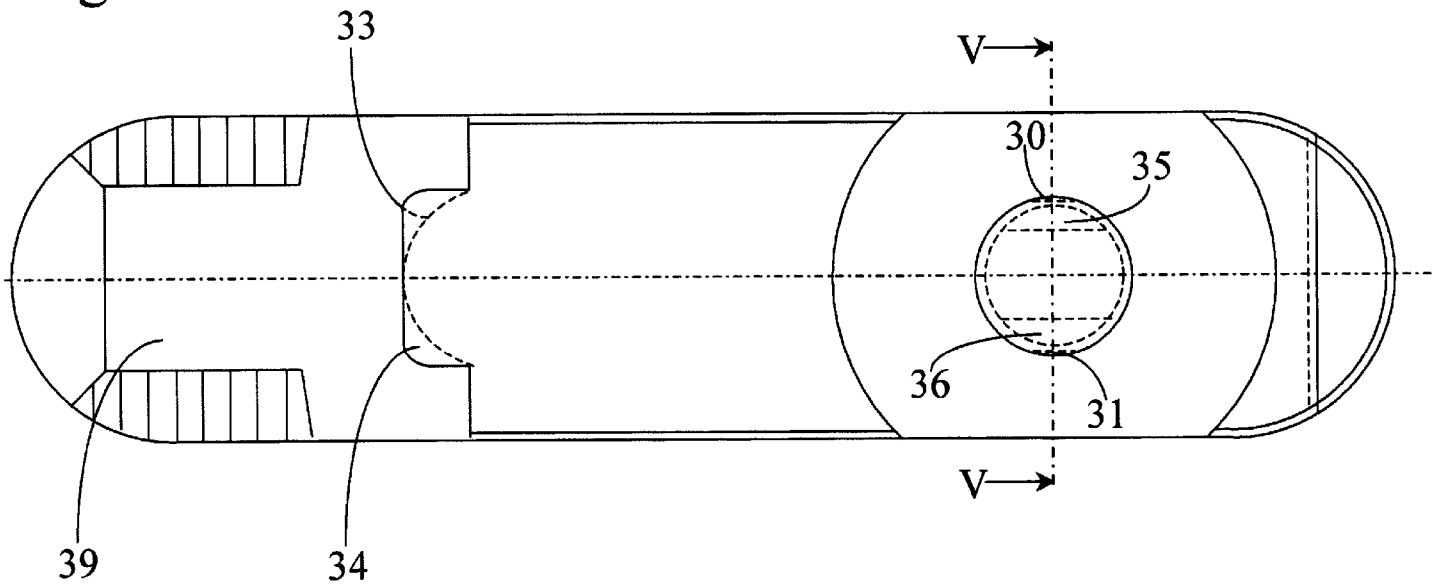
FIG. 4 is a bottom view of the boot sole represented in FIG. 3.
Figure 3:
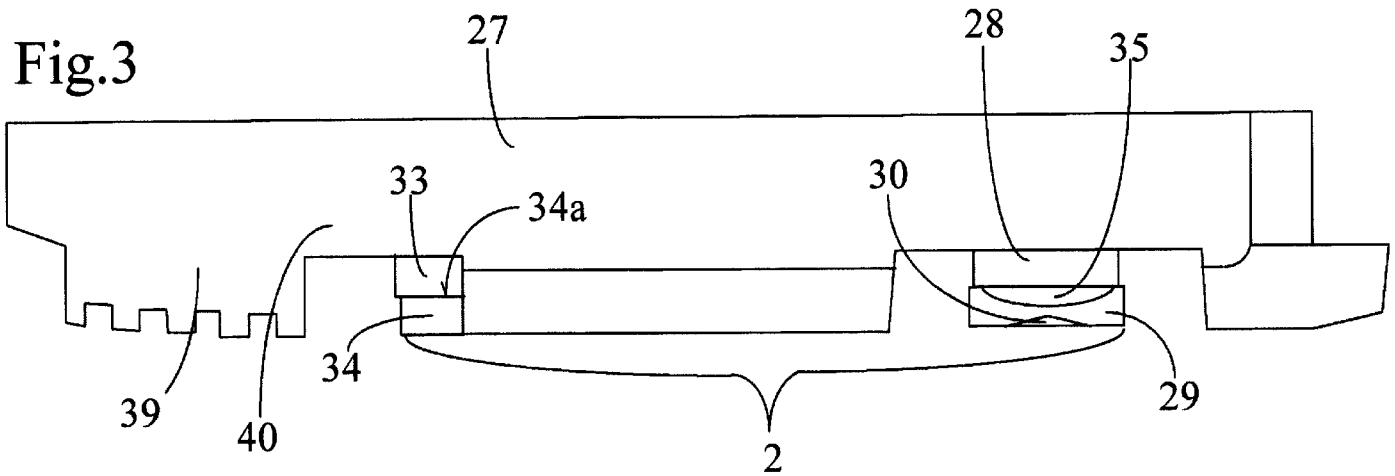
FIG. 3 is a side view of the boot sole intended to be fixed to the binding.
Figure 5:
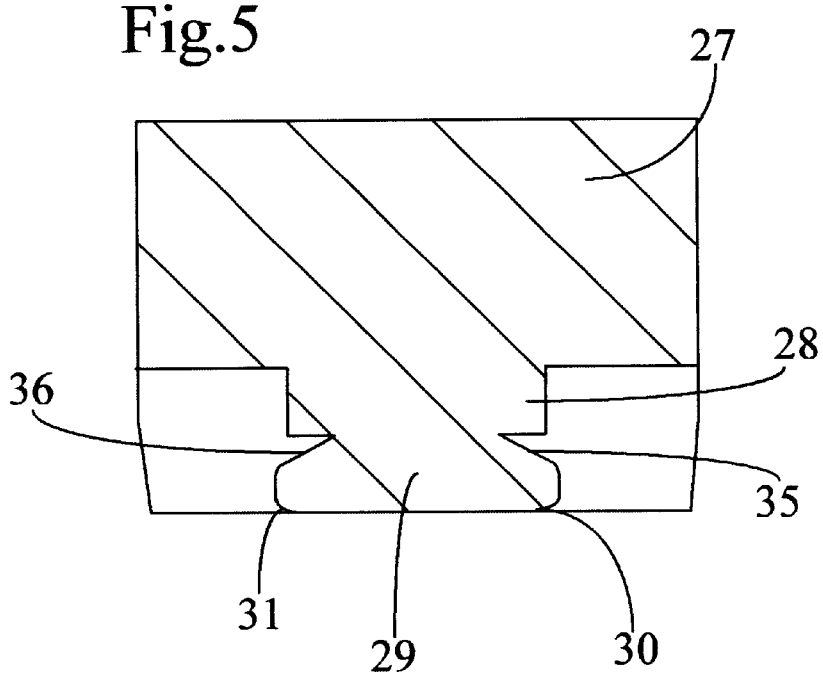
FIG. 5 is a view in section on V—V of FIG. 4.

The part 2, represented in FIGS. 3 and 4, is integrated with the sole 27 of a boot. It comprises a cylindrical stud 28 fitted with a head 29, also cylindrical, with a diameter larger than the diameter of the stud 28 and whose lower edges have two chamfers 30 and 31 arranged symmetrically relative to the longitudinal axis of the sole and whose upper edge also has two chamfers 35 and 36 which are symmetrical relative to the longitudinal axis of the sole and which penetrate into the stud 28 to form indentations, as can be seen in FIG. 5. The front end of the part 2 has a projecting part in the form of an arc of a circle 33, under which a rectangular projecting part 34, juxtaposed with the part 33 and extending laterally beyond the latter so as to form two plane support surfaces 34*a* on either side of the part 33.

It can be seen in FIG. 4 that the part 2 extends over only a part of the length of the sole, which, in front of the part 2, has a step structure 39 separated from the part 2 by a space making it possible to obtain an intermediate zone 40 having a degree of flexibility to make it easier to walk.

The rail 4 has two lateral windows 32 which face the support piece 18 and whose edge is graduated in order to display the setting of the precompression of the springs 19.

In order to fit the boot in the binding, the support surfaces 34*a* of the part 2 are engaged under the jaw 21 so that the rounded part 33 comes to bear in the V-shaped notch 23. The head 29 of the stud 28 comes to lie in front of the lateral jaws 7 and 8, the lower chamfers 30 and 31 coming to bear on the top of the chamfers 11 and 12 of tho jaws. Under the pressure exerted by the heel, the head 29 moves the jaws 7 and 8 apart by sliding over their chamfers 11 and 12 while compressing the Gags 19. The jaws 7 and then re-close over the chamfers 35 and 36, pressing the sole onto the binding. The effect of the oblique orientation of the chamfers 11 and 12 of the jaws is to push the sole forward and apply the rounded front part 33 of is the part 2 into the V-shaped notch 23 of the front jaw 21. The boot is hence securely held both transversely and longitudinally.

In the event of falling forward, the head 29 of the boot moves the lateral jaws 7 and 8 apart, compressing the springs 19. The front jaw 21 pivots on its swivel 22, pushing the slide 20 back slightly. The boot can hence come out of the binding.

In the event of falling backward, the tilt of the front jaw 21 and the movement apart of the lateral jaws 7 and 8 also take place simultaneously.

Under twisting, the stud 28 can tun between the lateral jaws 7 and 8, and the boot escapes first from the front jaw 21, and then the jaws 7 and 8, the springs 19 being compressed only by the front jaw 21.

As already mentioned above, intentional boot release is carried out by pressure on the lever 24, which frees the lateral jaws 7 and 8 and makes it possible to take the boot out of these jaws. The boot can then be taken out of the font jaw 21, as in the case of a conventional toe piece.

The binding which has been described provides stable fastening of the boot at three points. The same result could be obtained by placing the jaw 21 behind the lateral jaws 7 and 8, it being possible for the latter to be placed further forward relative to the heel of the boot. In particular, the jaw 21 could retain the heel of a boot having a rear ridge. In this case, the fitting of the boot would start by engaging the heel under its retaining jaw.

The lateral jaws could have some other shape matched to the shape of the sole of the boot.

The coil springs 19 could be replaced by one or more leaves working in buckling mode.

The part 2 could be without the support surfaces 34. In this case, the jaw 21 would provide only horizontal retention, under twisting.

It should be pointed out that the diameter of the head of the stud 28 could be equal to or less than the diameter of the stud, that is to say formed by a channel into which the jaws penetrate.

The boot could instead be pushed forward by engagement ramps on the part 2, against which ramps the jaws would come to bear.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A releasable binding for a gliding board, comprising a first portion secured to a boot and a second portion intended to be fixed on a gliding board, in which the second portion includes a pair of jaws which can be moved with respect to one another against the pressure of an elastic means, and in which the jaws and the first portion cooperate to move the jaws when the boot is being fitted in the binding and, upon release, hold the boot on the gliding board after fitting of the boot, the binding further comprising a pivoting jaw retainer biased into an upright boot-retaining position by an elastic means which, upon the exertion of sufficient force, moves in a direction so as to release the boot and which opposes at least a twisting movement about an at least approximately vertical axis of the part secured to the boot.

2. The binding as claimed in claim 1, wherein the jaw retainer is located in front of the jaws.

3. The binding as claimed in claim 1, wherein jaw retainer articulates on a swivel joint and further comprises a slide biased against the lower part of said jaw retainer by an elastic means, so as to hold this jaw in a predetermined position.

4. The binding as claimed in claim 3, wherein the elastic means retaining the pair of jaws is mounted between this pair of jaws and the jaw retainer of the additional holding means, thus simultaneously biasing the additional holding means.

5. The binding as claimed in claim 4, wherein the jaws are in the form of a lever of the first class whose axis is parallel to the longitudinal axis of the binding, and wherein the jaws bear on a horizontally and axially sliding cam retained by said elastic means.

6. The binding as claimed in claim 5, wherein said cam is a V-shaped cam.

7. The binding as claimed in claim 5, which comprises means for precompressing and adjusting the precompression of the elastic means, consisting essentially of a longitudinal adjusting screw.

8. The binding as claimed in claim 7, wherein the adjusting screw is screwed into said cam so as to be retained axially by this cam, and wherein its end bears a sliding support piece that in turn bear on the elastic means.

9. The binding as claimed in claim 8, wherein the second portion comprises a base having a rail in which the sliding pieces of the second portion are mounted.

10. The binding as claimed in claim 5, wherein the second portion comprises means for freeing the jaws, consisting of a boot-release lever and of a thrust piece between the lever and said cam, transmitting the force of the lever to the cam in order to push the cam back against the action of the elastic means.

11. The binding as claimed in claim 3, wherein the elastic means consists of a pair of springs working in compression.

12. The binding as claimed in claim 3, wherein the elastic means consists of at least one leaf working in buckling mode.

13. The binding as claimed in claim 1, wherein the first portion comprises a cylindrical stud fitted with a head intended to be retained by the jaws.

14. The binding as claimed in claim 13, wherein the jaws have engagement ramps oriented obliquely relative to the longitudinal axis of the binding and converging in the opposite direction from the additional holding means so as to exert a thrust on said stud in the direction of the additional holding means.

* * * * *